US006804173B2

(12) United States Patent
Yiu

(10) Patent No.: US 6,804,173 B2
(45) Date of Patent: Oct. 12, 2004

(54) ROTARY MEMBERS FOR TIMEPIECE HAVING REFLECTOR SHEETS

(76) Inventor: Chih Hao Yiu, 17F-B, No. 306, Junggang Road, Taichung (TW), 404

( * ) Notice: Subject to any disclaimer, the term of this patent is extended or adjusted under 35 U.S.C. 154(b) by 43 days.

(21) Appl. No.: 10/280,291

(22) Filed: Oct. 28, 2002

(65) Prior Publication Data

US 2004/0081028 A1 Apr. 29, 2004

(51) Int. Cl.[7] ..... G04C 3/00; G04C 9/00
(52) U.S. Cl. ..... 368/220
(58) Field of Search ..... 368/63, 72–74, 368/80, 220; 250/230

(56) References Cited

U.S. PATENT DOCUMENTS 4,031,386 A * 6/1977 Recker ..... 250/230
5,231,612 A 7/1993 Allgaier et al. ..... 368/47
5,293,356 A * 3/1994 Chin-Hsing ..... 368/63
5,566,140 A * 10/1996 Kohata et al. ..... 368/220
5,734,474 A 3/1998 Haocker et al. ..... 356/375
5,930,205 A * 7/1999 Baba et al. ..... 368/80
5,999,495 A * 12/1999 Hashizume et al. ..... 368/80

FOREIGN PATENT DOCUMENTS

JP 10275374 A * 10/1998
JP 2000035489 A * 2/2000

* cited by examiner

*Primary Examiner*—David Martin
*Assistant Examiner*—Jeanne-Marguerite Goodwin
(74) *Attorney, Agent, or Firm*—Charles E. Baxley

(57) ABSTRACT

A timepiece includes a light emitting device for generating a light, and one or more rotary wheels having one or more light receiving orifices, and one or more reflective members attached onto the sides of the rotary wheels for reflecting the light generated by the light emitting device and emitted through the orifices of the rotary wheels. The orifices may be easily and precisely formed in the rotary wheels while forming the rotary wheels, and the reflective members may be easily attached onto the rotary wheels without precisely positioning relative to the rotary wheels.

4 Claims, 3 Drawing Sheets

ROTARY MEMBERS FOR TIMEPIECE HAVING REFLECTOR SHEETS

BACKGROUND OF THE INVENTION

1. Field of the Invention

The present invention relates to a timepiece, and more particularly to a timepiece including one or more rotary members or wheels having mirrors or reflector sheets or members that may be easily attached or secured onto the rotary members or wheels.

2. Description of the Prior Art

Various kinds of typical timepieces have been developed, and may be used for automatically setting or detecting or correcting the time or the rotary members or the hands thereof.

U.S. Pat. No. 5,231,612 to Allgaier et al., and U.S. Pat. No. 5,734,474 to Haecker et al. disclose two of the typical timepieces, and comprise one or more rotary members or wheels each having one or more mirrors or reflector members for reflecting the light from an illumination device or scanning device.

In most of the typical timepieces, the mirrors or reflector members are disposed on the sides of the rotary wheels that face toward the illumination device or scanning device for reflecting the light from an illumination device or scanning device.

For accurately reflecting the light, the mirrors or reflector members should be precisely shaped and cut into the required sizes and areas and shapes, and should be precisely secured or adhered onto the sides of the rotary members or wheels that face toward the illumination device or scanning device for allowing the mirrors or reflector members to suitably and precisely reflect the light from the illumination device.

However, it will be time consuming and it will be difficult to precisely shape and cut the mirrors or reflector members into the required sizes and areas and shapes, and should also be precisely and carefully secured onto the sides of the rotary members or wheels that face toward the illumination device or scanning device, before the mirrors or reflector members may precisely and accurately reflect the light from the illumination device or scanning device.

The present invention has arisen to mitigate and/or obviate the afore-described disadvantages of the conventional timepieces.

SUMMARY OF THE INVENTION

The primary objective of the present invention is to provide a timepiece including one or more rotary members or wheels having reflector sheets or members that may be easily and quickly attached or secured onto the rotary members or wheels without precisely positioning to the rotary wheels.

In accordance with one aspect of the invention, there is provided a timepiece comprising a light emitting device for generating a light, a first rotary wheel including at least one orifice formed therein, and including a first side facing away from the light emitting device, and at least one first reflective member attached onto the first side of the first rotary wheel, and blocking the orifice of the first rotary wheel, for reflecting the light generated by the light emitting device.

A second rotary wheel may further be provided and includes at least one orifice formed therein, and a first side facing away from the light emitting device, and at least one second reflective member attached onto the first side of the second rotary wheel, and blocking the orifice of the second rotary wheel, for reflecting the light generated by the light emitting device, the first rotary wheel includes at least one hole formed therein for receiving the light generated by the light emitting device, and for allowing the light to emit onto the second rotary wheel.

A third rotary wheel may further be provided and includes at least one orifice formed therein, and a first side facing away from the light emitting device, and at least one third reflective member attached onto the first side of the third rotary wheel, and blocking the orifice of the third rotary wheel, for reflecting the light generated by the light emitting device, the second rotary wheel includes at least one hole formed therein for receiving the light generated by the light emitting device, and for allowing the light to emit onto the third rotary wheel.

A fourth rotary wheel may further be provided and includes at least one orifice formed therein, and a first side facing away from the light emitting device, and at least one fourth reflective member attached onto the first side of the fourth rotary wheel, and blocking the orifice of the fourth rotary wheel, for reflecting the light generated by the light emitting device, the third rotary wheel includes at least one hole formed therein for receiving the light generated by the light emitting device, and for allowing the light to emit onto the fourth rotary wheel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
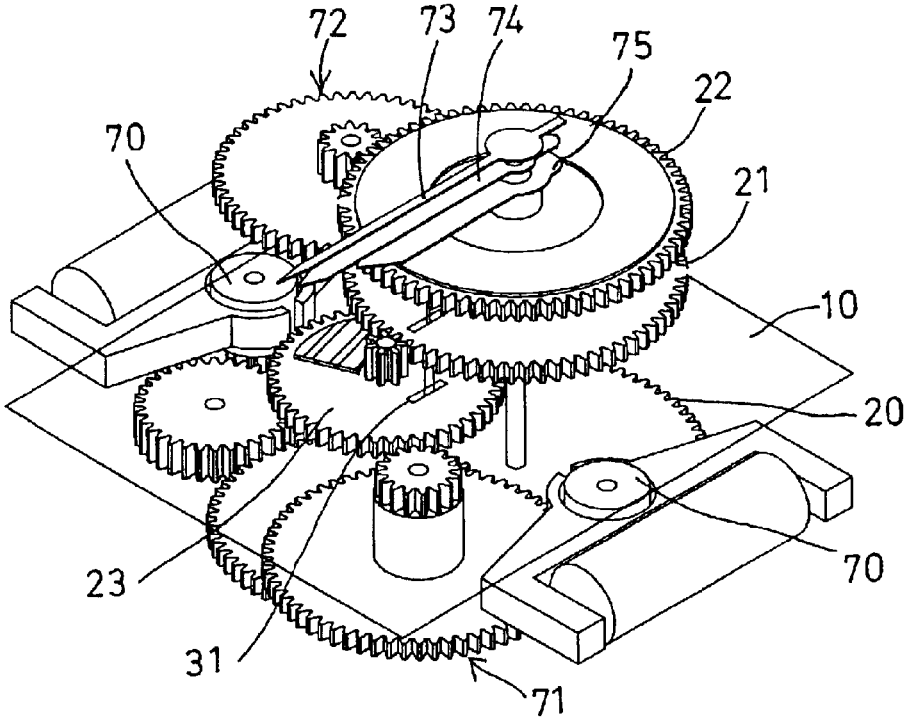
FIG. 1 is a partial upper perspective view of a timepiece in accordance with the present invention, in which the outer housing has been removed for showing the inner structure of the timepiece.
Figure 2:
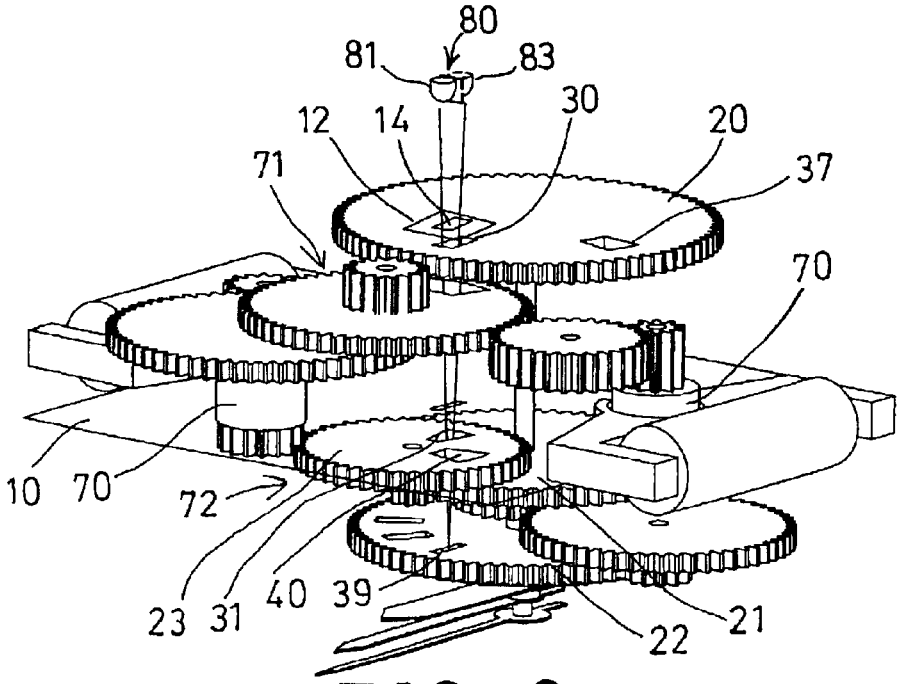
FIG. 2 is a partial bottom perspective view of the timepiece, in which the outer housing has also been removed for showing the inner structure of the timepiece.
Figure 3:
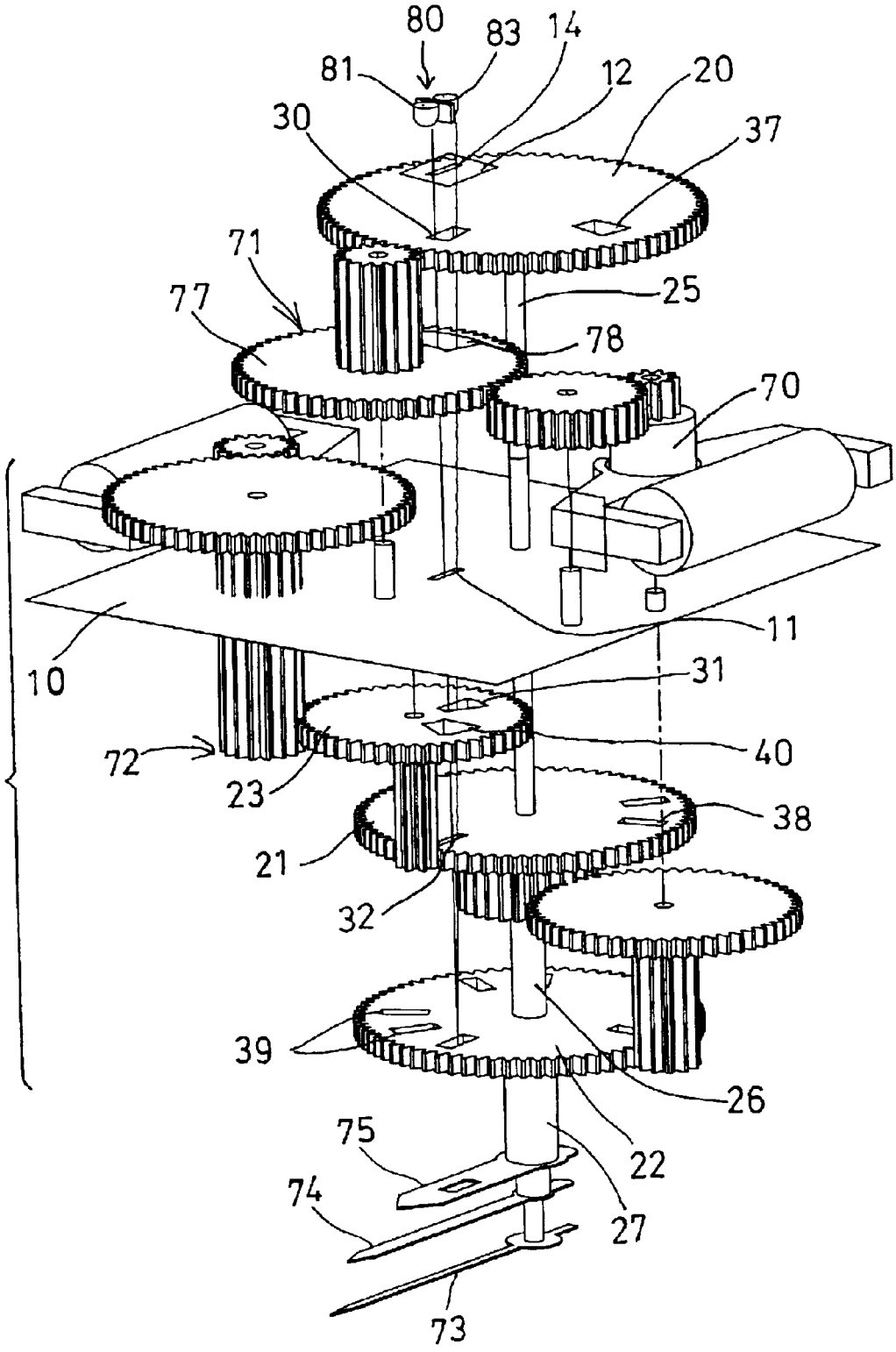
FIG. 3 is a partial exploded view of the timepiece.
Figure 5D:
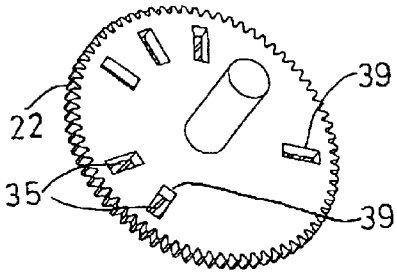
FIGS. 5A, 5B, 5C, 5D are bottom perspective views illustrating the four rotary members of FIGS. 4A, 4B, 4C, 4D respectively.
Figure 4D:
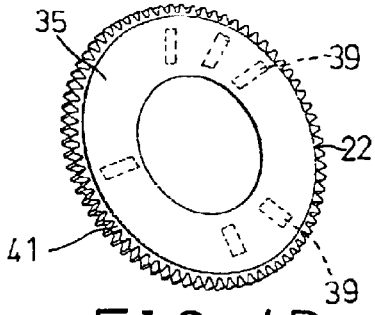
FIGS. 4A, 4B, 4C, 4D are upper perspective views illustrating four of the rotary members of the timepiece.
Figure 5C:
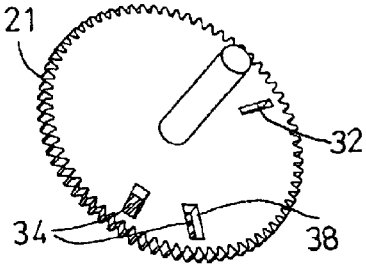
Figure 4C:
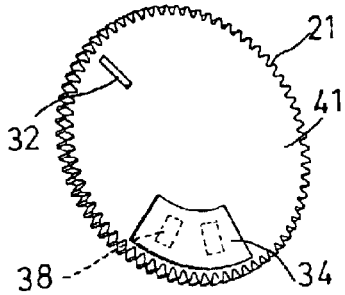
Figure 5B:
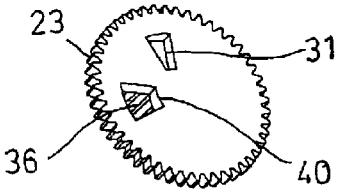
Figure 4B:
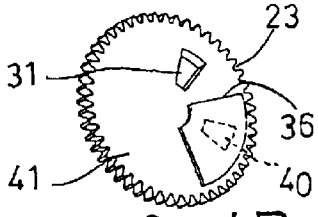
Figure 5A:
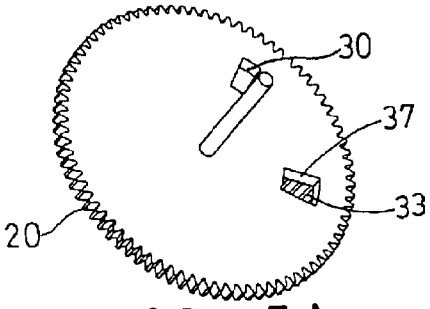
Figure 4A:
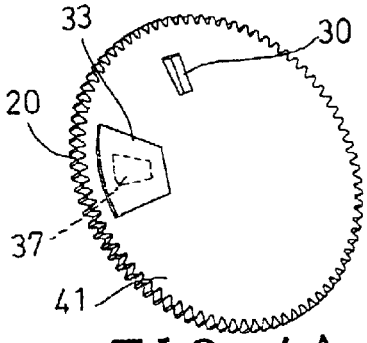

Referring to the drawings, and initially to FIGS. 1–3, a timepiece in accordance with the present invention comprises a number of rotary members or wheels 20, 21, 22, 23 which may either be a second, a minute, or an hour wheel, or the other coupling or transmission gearing wheels, and which may be received in a housing (not shown).

For example, the rotary wheels 20–22 represent the second wheel, the minute wheel, and the hour wheel respectively, and coupled together with one or more gearing mechanisms 71, 72 which are coupled to one or more motors 70, such as the step motors 70 that may rotate and drive the rotary wheels 20–22. The rotary wheel 23 may be one member of either of the gearing mechanisms 71, 72.

The rotary wheels 20–22 may be rotatably supported on a board 10 with shafts 25, 26, 27 that are concentric to each other and that are coupled to hands 73, 74, 75 respectively, for allowing the hands 73–75 to be rotated or driven by the shafts 25–27 and the rotary wheels 20–22 respectively, and to be rotated independently and to be rotated relative to each other.

A detecting device 80 includes a light emitting part or device 81 for generating lights, and a light receiving part or device 83 for receiving reflective lights. The rotary wheels 20–23, and the detecting device 80 are typical and will not be described in further details.

As shown in FIGS. 4A–4D, and 5A–5D, the rotary wheels 20, 23, 21 each includes one or more holes 30, 31, 32 formed therein for receiving the light generated by the light emitting device 81 of the detecting device 80, and for allowing the light to emit through the holes 30–32 of the rotary wheels 20, 23, 21 respectively.

The rotary wheels 20–23 each may further include one or more reflective members 33, 34, 35, 36 disposed on the respective rotary wheels 20–23 for reflecting the light generated by the light emitting device 81 of the detecting device 80, toward the light receiving device 83.

The rotary wheels 20–23 are preferably made of non-reflective materials, such as the plastic or synthetic materials. Only the reflective members 33–36 may be used to reflect the light generated by the light emitting device 81 of the detecting device 80.

The rotary wheels 20–23 each further includes one or more orifices 37, 38, 39, 40 formed therein. For example, the orifices 37–40 may be precisely and easily formed in the rotary wheels 20–23 respectively while the rotary wheels 20–23 are formed by such as molding, punching, mold injection processes, or the like.

The reflective members 33–36 may then be shaped or cut into various shapes that have areas corresponding to that of the orifices 37–40 of the rotary members 20–23, such as smaller or greater than the orifices 37–40 of the rotary members 20–23 respectively, and may be quickly attached or secured to the sides 41 (FIGS. 4A–4D) of the rotary members 20–23 that face away from the light emitting device 81, and to partially or completely block the orifices 37–40 of the rotary members 20–23 respectively, without precisely positioning the reflective members 33–36 relative to the rotary members 20–23.

For example, the reflective members 33–36 may be shaped or cut into a shape having either or both a length and a width greater than that of the orifices 37–40 of the rotary members 20–23, for allowing the reflective members 33–36 to be attached onto the rotary members 20–23, and for partially or completely blocking or shielding the orifices 37–40 of the rotary members 20–23.

After the reflective members 33–36 has been secured onto the rotary members 20–23, to partially or completely block or shield the orifices 37–40 of the rotary members 20–23, the light from the light emitting device 81 and emitted through the orifices 37–40 of the rotary members 20–23 may thus be reflected back to the light receiving device 83 by the reflective members 33–36.

A transparent or semi-transparent adhesive layer may further be provided and applied onto the reflective members 33–36, for allowing the reflective members 33–36 to be easily and quickly and readily attached onto the rotary members 20–23 by the users.

In operation, as shown in FIG. 3, the rotary wheel 20 may be rotated or driven by the motor 70 and the gearing mechanism 71, to align either the hole 30 or the orifice 37 of the rotary wheel 20 with the light emitting device 81 of the detecting device 80, for allowing the light to emit through the hole 30 of the rotary member 20, or for allowing the light to be reflected by the reflective member 33 that partially or completely blocks or shields the orifice 37 of the rotary member 20.

When the light may pass through the hole 30 of the rotary member 20, the rotary wheel 23 may also have chances to be rotated or driven by the motor 70 and the gearing mechanism 72, to align either the hole 31 or the orifice 40 of the rotary wheel 23 with the light emitting device 81 of the detecting device 80, for allowing the light to emit through the hole 31 of the rotary member 23, or for allowing the light to be reflected by the reflective member 36 that partially or completely blocks or shields the orifice 40 of the rotary member 23.

When the light may pass through the hole 30, 31 of the rotary member 20, 23, the rotary wheel 21 may also have chances to be rotated or driven by the motor 70 and the gearing mechanism 72, to align either the hole 32 or the orifice 38 of the rotary wheel 21 with the light emitting device 81 of the detecting device 80, for allowing the light to emit through the hole 32 of the rotary member 21, or for allowing the light to be reflected by the reflective member 34 of the rotary member 21.

When the light may pass through the hole 30, 31, 32 of the rotary member 20, 23, 21, the rotary wheel 22 may also have chances to be rotated or driven by the motor 70 and the gearing mechanism 72, to align either of the orifice 39 of the rotary wheel 22 with the light emitting device 81 of the detecting device 80, for allowing the light to be reflected by the reflective members 35 of the rotary member 22.

It is to be noted that the rotary members 21, 22 may include a single reflective member 34, 35 to block the orifices 38, 39 of the rotary members 21, 22 respectively, or may include two or more reflective members 34, 35 to completely or partially block the orifices 38, 39 of the rotary members 21, 22 respectively.

It is further to be noted that the reflective member 33–36 may be easily and quickly shaped or cut into various shapes that have areas or lengths or widths greater than the orifices 37–40 of the rotary members 20–23 respectively, and may be quickly attached or secured to the rotary members 20–23 and to completely or partially block the orifices 37–40 of the rotary members 20–23 respectively, without precisely positioning the reflective member 33–36 relative to the rotary members 20–23.

The reflective members 33–36 may be easily and precisely aligned with the light emitting device 81 of the detecting device 80 by the orifices 37–40 of the rotary members 20–23 respectively, and the orifices 37–40 may be easily and quickly formed in the respectively rotary members 20–23 while the rotary members 20–23 are formed by such as molding, punching, mold injection processes or the like.

As shown in FIG. 3, the board 10 may include one or more apertures 11 formed therein for receiving the light generated by the light emitting device 81 of the detecting device 80, and for allowing the light to emit through the apertures 11 of the board 10. A barrier or a shield 12 may further be provided and includes one or more passages 14 formed therein for receiving the light generated by the light emitting device 81 of the detecting device 80, and for guiding the light to emit through the apertures 11 of the board 10 and the hole 30, 31, 32 of the rotary member 20, 23, 21.

The gearing mechanisms 71, 72 may further include one or more further rotary wheels 77 each having one or more grooves 78 formed therein for receiving the light generated by the light emitting device 81 of the detecting device 80, and for guiding the light to emit through the grooves 78 of the rotary wheels 77.

Accordingly, the timepiece in accordance with the present invention includes one or more rotary members or wheels having reflector sheets or members that may be easily and quickly attached or secured onto the rotary members or wheels without precisely positioning to the rotary wheels.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A timepiece comprising:

a light emitting device for generating a light, a first rotary wheel including at least one orifice formed therein, and including a first side facing away from said light emitting device, and at least one first reflective member attached onto said first side of said first rotary wheel, and at least partially blocking said at least one orifice of said first rotary wheel, and arranged to reflect the light generated by said light emitting device and emitted through said at least one orifice of said first rotary wheel.

2. The timepiece according to claim 1 further comprising a second rotary wheel including at least one orifice formed therein, and including a first side facing away from said light emitting device, and at least one second reflective member attached onto said first side of said second rotary wheel, and at least partially blocking said at least one orifice of said second rotary wheel, and arranged to reflect the light generated by said light emitting device via said at least one orifice of said second rotary wheel, said first rotary wheel including at least one hole formed therein for receiving the light generated by said light emitting device, and for allowing the light to emit onto said second rotary wheel.

3. The timepiece according to claim 2 further comprising a third rotary wheel including at least one orifice formed therein, and including a first side facing away from said light emitting device, and at least one third reflective member attached onto said first side of said third rotary wheel, and at least partially blocking said at least one orifice of said third rotary wheel, and arranged to reflect the light generated by said light emitting device via said at least one orifice of said third rotary wheel, said second rotary wheel including at least one hole formed therein for receiving the light generated by said light emitting device, and for allowing the light to emit onto said third rotary wheel.

4. The timepiece according to claim 3 further comprising a fourth rotary wheel including at least one orifice formed therein, and including a first side facing away from said light emitting device, and at least one fourth reflective member attached onto said first side of said fourth rotary wheel, and at least partially blocking said at least one orifice of said fourth rotary wheel, and arranged to reflect the light generated by said light emitting device via said at least one orifice of said fourth rotary wheel, said third rotary wheel including at least one hole formed therein for receiving the light generated by said light emitting device, and for allowing the light to emit onto said fourth rotary wheel.

* * * * *